United States Patent [19]

Nordlund et al.

[11] 4,072,086

[45] Feb. 7, 1978

[54] DRIVING ASSEMBLY

[76] Inventors: Karl Signar Nordlund, Bjarshog, 212 90 Malmo; Kjell Berglund, Revingevagen 4, 240 35 Harlosa, both of Sweden

[21] Appl. No.: 656,792

[22] Filed: Feb. 10, 1976

[30] Foreign Application Priority Data

Feb. 10, 1975 Sweden ..... 7501416

[51] Int. Cl.[2] ..... F15B 11/08; F01B 19/00

[52] U.S. Cl. ..... 91/418; 92/44; 92/92; 92/140

[58] Field of Search ..... 92/92, 140, 48, 44, 92/89, 90, 91; 91/418

[56] References Cited

U.S. PATENT DOCUMENTS

| | | | |
|---|---|---|---|
| 2,001,744 | 5/1935 | Patterson | 92/92 |
| 2,076,071 | 4/1937 | De Bolt | 92/92 |
| 2,673,064 | 3/1954 | Patterson | 92/92 |
| 3,004,559 | 10/1961 | Warman, Jr. | 92/92 |
| 3,005,337 | 10/1961 | El Waziri | 92/92 |
| 3,120,205 | 2/1964 | Pfeiffer | 92/92 |

FOREIGN PATENT DOCUMENTS

| | | |
|---|---|---|
| 705,287 | 11/1930 | France. |
| 1,231,402 | 12/1966 | Germany. |
| 2,007,429 | 9/1971 | Germany. |
| 321,438 | 2/1970 | Sweden. |
| 349,546 | 2/1972 | Sweden. |

*Primary Examiner*—Martin P. Schwadron
*Assistant Examiner*—Abraham Hershkovitz
*Attorney, Agent, or Firm*—Bacon & Thomas

[57] ABSTRACT

A driving assembly for moving one unit with respect to another, for instance, a working unit with respect to a frame unit. Preferred practical applications for the driving assembly are lifting platforms or presses. The driving assembly includes a flat, enclosed, flexible container or bladder disposed between the two units. End wall portions of the container comprise the major surface area thereof. When pressure is introduced into the container, the walls thereof bear entirely against opposed bearing portions of the respective units and against a limiting wall. The invention allows for use of a very thin walled container for lifting large loads.

11 Claims, 2 Drawing Figures

DRIVING ASSEMBLY

BACKGROUND

1. Field of the Invention

The present invention relates to a driving assembly adapted to actuate a unit in relation to a frame unit, such as in the case of lifting platforms to raise a working portion in relation to a platform or as in the case of press devices to move a press member in relation to a machine frame.

2. Description of the Prior Art

It is previously known to use driving assemblies of elastic material for the abovementioned purposes. The prior art driving assemblies, however, have essential limitations as far as capacity and/or safety of operation is concerned. Thus, for instance, thinwalled driving assemblies in the first place are inclined to expand in other directions than the working direction whereas driving assemblies of the thickwalled, doublewalled or reinforced type exert a great resistance and therefore require special high pressure in order to overcome this resistance.

The present invention has for its purpose to remove these drawbacks by means of a simple apparatus.

SUMMARY OF THE INVENTION

The driving assembly of the present invention includes a first unit and a first bearing portion with a first bearing surface. A second unit is moveable relative to the first unit. The second unit has a second bearing portion including a second bearing surface. The units are so disposed relative to each other that the first and second bearing surfaces are in opposed, spaced, face-to-face relationship. A flat, enclosed, flexible container engages the first and second units and is disposed therebetween. The enclosed flexible container has an outer surface area and an inner, expansible chamber. The enclosed flexible container has a pair of opposite end wall portions comprising the major portion of the outer surface area. The remaining outer surface area is defined by a side wall portion, at least when the container is in a pressurized condition. Means are coupled with the container for effecting communication with a pressure source. The shape of the flexible container is changeable, in response to introduction of fluid pressure, to move the first unit with respect to the second unit. A limiting wall cooperates with the opposite bearing surfaces, these surfaces and the limiting wall defining an enclosed area within which the enclosed, flexible container is entirely disposed. The end wall portions of the enclosed, flexible container bear substantially entirely against the bearing surfaces of the first and second units. The side wall portion of the enclosed flexible container bears against the limiting wall at least when the container is in a pressurized condition. Thus, movement of the container, in a direction other than the direction of relative movement between the units, is limited.

BRIEF DESCRIPTION OF THE DRAWING

The invention will be explained in more detail in the following specification with reference to the enclosed drawings in which FIG. 1 by means of a sectional view shows a driving assembly according to the invention adapted to lift the working portion of a lifting platform, and FIG. 2 by means of a sectional view shows said driving assembly in the ineffective position thereof with the lifting platform in the retracted position thereof.

DESCRIPTION OF THE PREFERRED EMBODIMENT

Figure 1:
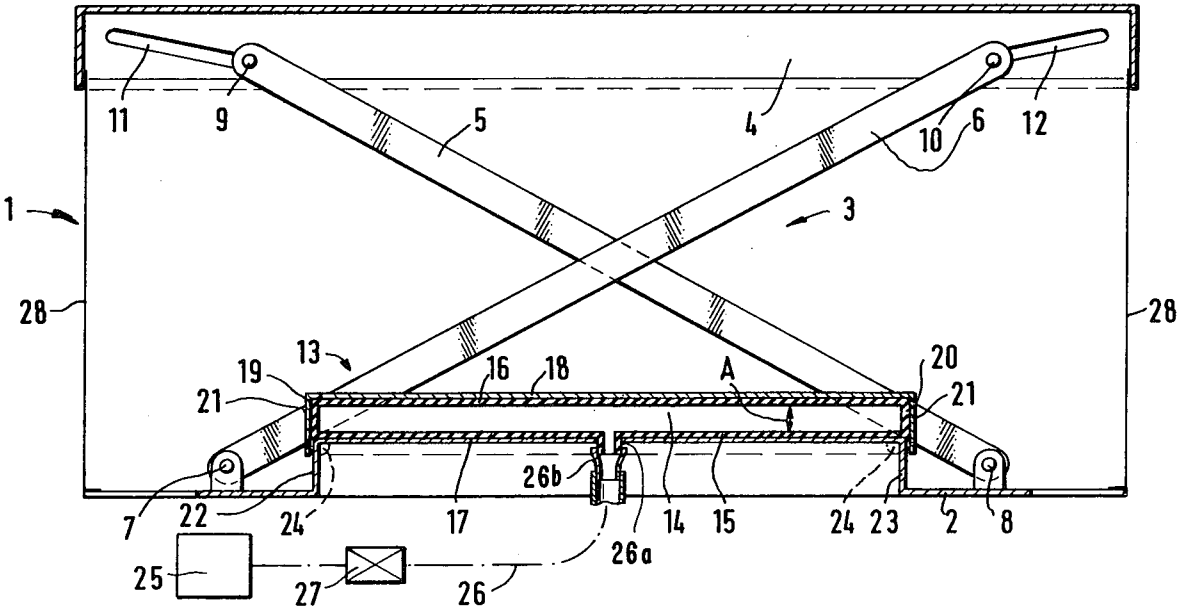

The lifting platform 1 shown in the drawings is provided with one unit including a frame portion 2 and a working portion or working unit 4 connected to the frame portion by means of a lever system 3. The lever system 3 preferably comprises two pairs of crosslaid levers 5, 6 (in the drawings only one pair is shown) which by means of pivot pins 7, 8 are pivotally connected to the frame portion 2. The lever include pins 9, 10 which slidably engage slots 11, 12 in the working portion 4. The working unit 4 is raised and lowered in relation to the frame portion 2 by means of a driving assembly 13. This is provided with a bladder 14 for a pressure medium, and the chief object of the invention is to make it possible to use a thinwalled bladder 14 so as to exert the smallest possible resistance during expansion and to be inexpensive manufacture. Moreover, the bladder 14 should allow a reliable operation of the power aggregate and, despite a simple and inexpensive construction, to allow lifting of large loads.

For this purpose the power aggregate 13 according to the invention in principle consists of the bladder 14 which has a flat shape and is adapted by increase of the pressure on the medium within the container to expand in direction (A) partly increasing the distance between two opposite end walls 15, 16 which are the surfaces of the bladder having essentially the largest areas. The end walls form pressure surfaces in that they substantially entirely bear against oppositely positioned bearing portions 17 and 18, respectively, of the units 2 and 4, respectively, and exert pressure against said portions, and partly changing the shape of wall portions 19, 20. These wall portions connect the end walls 15, 16 and are positioned within at least one limiting wall 21 adapted to limit expansion of the bladder 14 in other direction.

The following combination of features achieve what is sought: the bladder 14 is flat, it has end walls forming relatively very large pressure surfaces, and walls connecting the side walls and changing their shape are supported by at least one limiting wall.

In order to make the parts enclosing the bladder 14 simple and to enhance convenience, the bearing portion 18 of one (4) of the units forms the bottom of a preferably downwardly open container the side walls 21 of which form limiting walls for the shape changing, side wall portions 19, 20 of the flat bladder 14. Said container preferably is guided by the frame unit 2 in that the side walls 21 cooperate with the other unit.

In order to provide a simple and expedient structure also as far as portions of the frame unit 2 are concerned, said unit is provided with a bearing portion 17 having portions 22 and 23 extending from the bearing side, the side walls 21 of the open container extending along and adapted to be guided by said portions 22, 23. That is, the entireties of side walls 21 of unit 2 are disposed in parallel relationship with the entireties of walls 23 and 24 of unit 4 as is readily apparent from the drawing. As is also readily apparent from the drawing, the major portions of walls 21, on the other hand, and walls 22 and 23, on the other hand, overlap each other in face-to-face relationship when bladder 21 is in the de-pressurized condition. See particularly FIG. 2.

A particularly simple, expendient and very stable structure is provided when the bearing portions of the units 2, 4 consist of box-shaped containers in which the flat bladder 14 is mounted between the bottoms of the portions 17, 18 forming said containers. In that case a suitable guiding of the one container is provided in that the wall portions 21 and 22, 23 bear against each other either directly or by means of guiding rollers (not shown).

In order to allow simple assembly and removal, respectively, the bearing portion 18 of one (4), of the units may consist of a separate part guided by the other unit 2. This part cooperates with the lever system 3 connecting the frame unit 2 with the working unit 4. The levers 5, 6 of the lever system 3 may bear against the open container 18, 21 in a suitable manner either directly (for instance against the outside of the bottom 18 of the container) or by means of rollers 24 mounted on the container walls 21.

Figure 2:
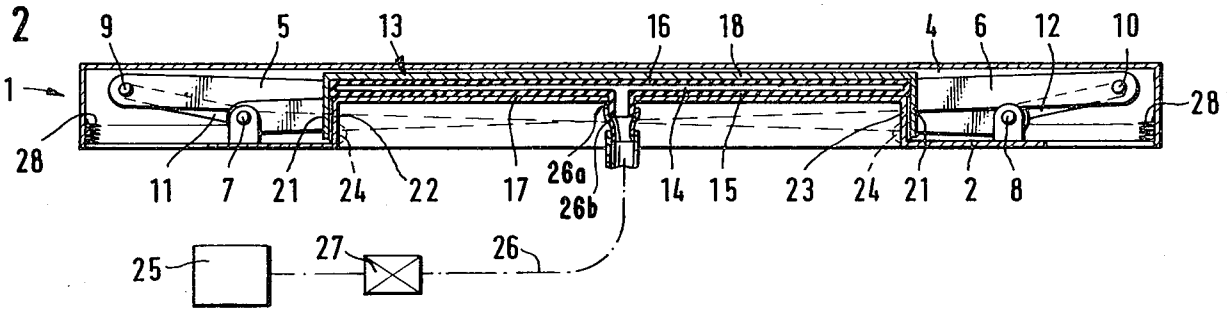

As appears from FIG. 2 the lifting platform 1 in the retracted position thereof has a total height which corresponds to or only slightly exceeds the total height of the working unit 4, and this is achieved in that the working unit 4 directly bears against the frame unit 2. In order to cover and to protect all of the movable parts of the lifting platform 1 in collapsed position thereof the working unit 4 is shaped as a container which is open towards the frame unit 2. The container thus formed covers said movable parts and also the frame portion 2. Due to the fact that the working unit 4 with its bottom is spaced from the frame unit 2 only by the end walls 15, 16 of the flat bladder 14 when they bear against each other or practically bear against each other, an extremely low profile is provided when the lifting platform 1 is collapsed. It is important that the flat bladder 14 is not charged when the lifting platform is collapsed but that said bladder 14 is completely unloaded. This is achieved in that the units have portions forming stops. Thus, for instance, the height of the wall 21 may be higher than the height of the walls 22, 23 to an extent that a space for the flat bladder 14 is formed when the wall 21 bears against the frame unit 2.

The bladder 14, consists of an elastic, flexible or ductile material such as rubber, plastic, impregnated paper or the like. In order to expand the same a pressure medium, such as air, oil, water or any other liquid or gas may be used. The pressure is generated by means of a suitable pressure source 25 connected to the flat bladder 14 by means of a conduit 26. For the shutting off and/or throttling of the pressure medium, the conduit 26 may be provided with a conventional valve means 27. As is clearly apparent from the drawing, the conduit 26 passes through an opening 26*a* in bearing portion 17 of the lower container and extends into the cavity formed by that container. As is also clearly apparent from the drawing, there is a coupling device 26*b* in conduit 26, the coupling device being disposed in the cavity formed by walls 17, 22 and 23 of the lower container.

In the lifting platform 1 described above, the details may be carried out in many ways within the scope of the invention. As examples of different alternatives, the levers 5, 6 of the lever system 3 may be locked to the working unit 4 in different positions of displacement, as far as the elements 9, 10 in relation to the slots 11, 12 are concerned, by means of any type of locking device (not shown). Furthermore, in order to eliminate hazards of clamping a screen 28 may be used which is coupled to the units 2, 4 and unfolded when the working unit 4 is raised to cover all of the movable parts at the sides when the working unit 4 has been raised. Moreover, the pressure source 25 may be provided with a pressure plate (not shown) which in case of an exterior loading, for instance when a vehicle is driven onto the same, will compress a container of a plastic material, said bladder being connected to the flat container so that an increase of the pressure therein will cause a pressure increase in the flat bladder. The flat bladder 14 for instance may be adapted to cooperate with a wheel undercarriage (not shown) so that the wheels occupy their running position for driving the frame unit 2 over an underlayer when the flat bladder 14 is in its collapsed position and so that the wheels occupy the resting position when the flat bladder 14 is in its inflated position.

From the above it is seen that a lifting platform using the driving assembly 13 according to the invention may include a great deal of valuable characteristic features the details of which however have not been more specifically explained. The lifting platform also is provided with means ensuring a parallel movement of the working unit in relation to the frame unit 2. However, this is not the subject matter to which the present invention is directed, and therefore it has not been more specifically described.

The driving assembly according to the invention may be used in connection with other structures than lifting platforms. By and large, the driving assembly may be used in connection with all kinds of structures where one unit is to be moved in relation to a frame unit, such as presses in which a press member is to be moved in relation to a machine frame.

We claim:

1. A driving assembly comprising:

a. a first unit having a portion with the form of a first open container, a bottom wall of which defines a first bladder bearing surface, said first container having a first container side wall extending from the peripheral portion of said bottom wall, said side wall, together with said first container bottom wall, defines a first cavity, said first container being open on the end opposite said first container bottom wall;

b. a second unit having a portion with the form of a second, open container, a bottom wall of which defines a second bladder bearing surface, said second container having a second container side wall extending from the peripheral portion of said second unit bottom wall, said second container side wall together with said second container bottom wall defines a second cavity, said second container being open on the end opposite said second container bottom wall, said second container being disposed within the cavity of said first container in telescopic, nested relationship therewith so that said first and second bearing surfaces are in opposed, spaced relationship, said first unit being movable relative to said second unit;

c. an expansible bladder engaging said first and second units and disposed therebetween, said bladder having an outer surface area and an inner expansible chamber; said bladder having a pair of opposite end wall portions comprising the major portion of said outer surface area of said bladder; the remaining outer surface area being defined by a side wall portion of said bladder at least when said container is in a pressurized condition;

d. means connected with said bladder for effecting communication with a pressure source, the shape of said bladder being changeable in response to a change in fluid pressure in said bladder to move said first unit with respect to said second unit, said communication means passing through said second bearing surface of said second unit and into said second container cavity, whereby said second container provides space for and protection for said communication means;

e. said first container side wall and said first and second container bottom walls defining an enclosed area within which said bladder is entirely disposed;

f. said bladder fully engaging the side of said second container bottom wall which faces away from said second container cavity, said bladder being disposed entirely outside said second container cavity, said bladder fully engaging the side of said first container bottom wall which faces toward said first container cavity of said first container, said bladder being disposed entirely within said first container cavity;

g. the entirety of said first container side wall being disposed in parallel relationship with the entirety of said second container side wall, the major portions of the first and second container side walls overlapping each other in face-to-face relationship when said bladder is in the depressurized condition, said first and second container side walls being movable relative to each other when the pressure in said bladder increases, said first and second container side walls cooperating with each other during such movement to guide and stabilize the movement of said first unit relative to said second unit.

2. A driving assembly as defined in claim 1, wherein said communication means is a conduit, said conduit including a coupling device therein, said conduit being disposed within said second cavity.

3. A driving assembly as defined in claim 1 including an opening in said second bearing surface, said conduit passing through said opening.

4. A driving assembly according to claim 1, wherein said first unit includes a working portion, the assembly including a lever system having at least one lever and means connecting said lever system and first and second units together such that movement of said first bearing surface is transfered through said lever system to move said working portion.

5. A driving assembly according to claim 4, in which said second unit includes a frame, said lever system having at least a pair of levers pivotally mounted on said frame and crossing each other between said working portion of said first unit and said first bearing surface thereof, said levers bearing against the outside of the bottom of said first open container.

6. A driving assembly according to claim 5, wherein said levers of said lever system are slidably coupled to said working portion of said first unit.

7. A driving assembly according to claim 5, wherein said fladder and said first first container are configured to allow said working portion of said first unit to directly bear against said frame when said bladder is depressurized.

8. A driving assembly according to claim 4, wherein said working portion of said first unit has the form of a container with a bottom and with wall portions, which container opens towards said second unit, said working portion being so disposed and configured as to cover, from the outside, said lever system and bearing surfaces of said units by means of said wall portions extending from said bottom of said working portion to cover said second unit when said bladder is depressurized.

9. A driving assembly according to claim 4, wherein a screen means is coupled to said first and second units to shield said lever system and said first bearing surface.

10. A driving assembly according to claim 1, including a valve between said pressure source and said bladder to shut off or throttle the communication therebetween.

11. A driving assembly according to claim 1 wherein said first and second units bear against each other when said bladder is depressurized.

* * * * *